United States Patent [19]

Elliott

[11] 4,051,641

[45] Oct. 4, 1977

[54] PANELIZED STRUCTURAL SYSTEM

[76] Inventor: James I. Elliott, Arcadia Manor, Upperco, Md. 21155

[21] Appl. No.: 387,044

[22] Filed: Aug. 9, 1973

[51] Int. Cl.[2] ..... E04B 7/02; E04B 1/30

[52] U.S. Cl. ..... 52/262; 52/92; 52/282; 52/403; 52/584; 52/592

[58] Field of Search ..... 52/92, 281, 282, 580, 52/584, 593, 592, 262, 403

[56] References Cited

U.S. PATENT DOCUMENTS

| | | | |
|---|---|---|---|
| 1,702,340 | 2/1929 | Gates | 52/92 |
| 2,076,728 | 4/1937 | Keller | 52/584 |
| 2,629,140 | 2/1953 | Clements | 52/593 X |
| 2,825,098 | 3/1958 | Hultquist | 52/582 X |
| 3,397,500 | 8/1968 | Watson, Jr. | 52/282 X |

FOREIGN PATENT DOCUMENTS

| | | | |
|---|---|---|---|
| 642,998 | 6/1962 | Canada | 52/92 |
| 1,454,749 | 8/1966 | France | 52/92 |

*Primary Examiner*—Alfred C. Perham
*Attorney, Agent, or Firm*—John F. McClellan, Sr.

[57] ABSTRACT

A quick-assembly building system employing pre-constructed exterior wall panels of generally parallelogram-shape section permitting interchangeable insertion free of intervening studding to form flat sidewalls; a bolted-together lightweight roof, corner post, flooring and sill building frame construction of aluminum and wood complements the wall panels, permitting erection of a dwelling-size building by four men in one day, using hand tools only.

1 Claim, 17 Drawing Figures

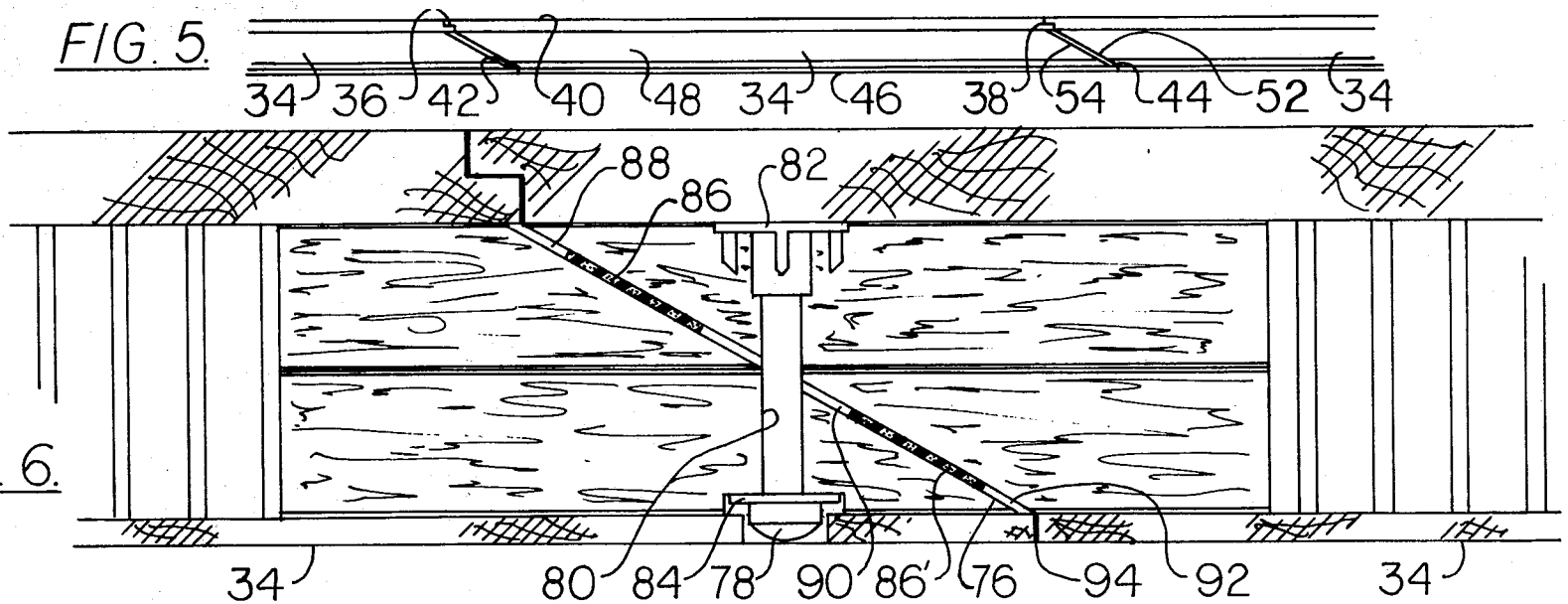
FIG. 5
FIG. 6.
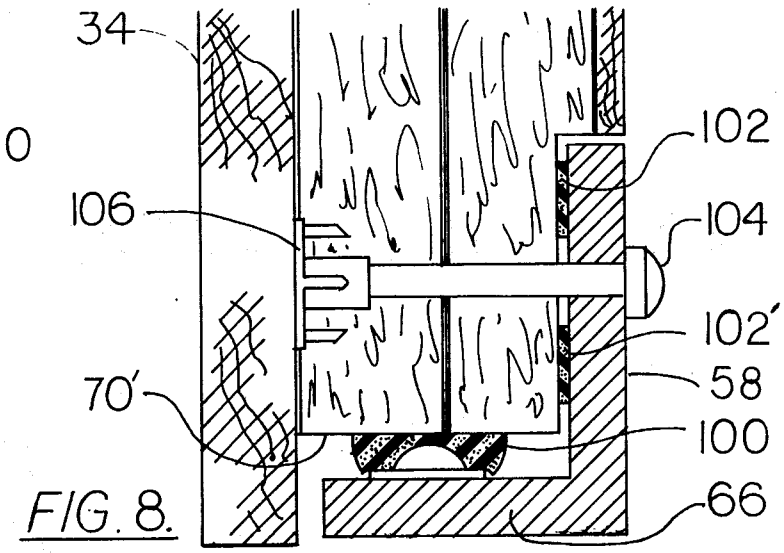
FIG. 8.
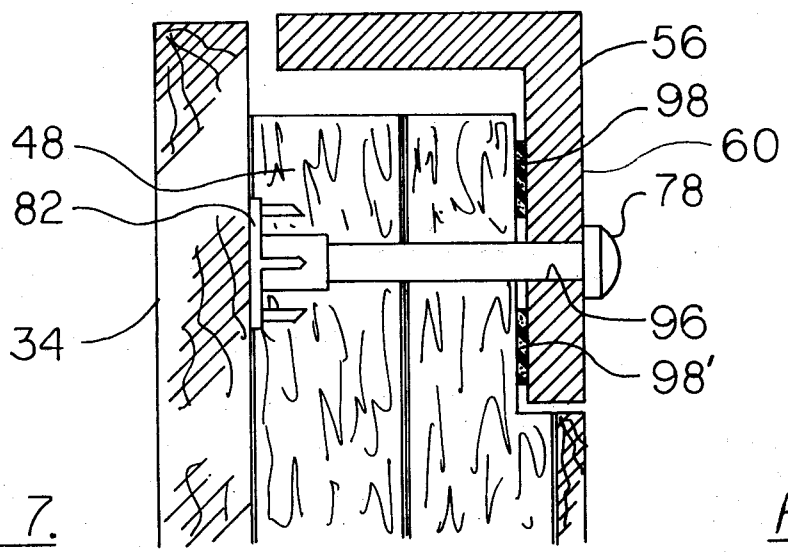
FIG. 7.

PANELIZED STRUCTURAL SYSTEM

This invention relates generally to building structures such as dwellings and particularly to pre-fabricated structures for on-site assembly.

In the prior art numerous disclosures have been made of the type structure described, including all-wood buildings, all-metal buildings, and composite material buildings. Examples of some of these appear in U.S. Pat. Nos. 3,004,321; 2,717,668; 2,176,778; 2,131,477 and 1,920,490.

However, in spite of the obvious desirability of having moderate cost buildings available for quick, simple erection and knockdown, suitable for semi-permanent use, to date no such building has become the standard article of commerce for the purpose.

High cost, odd appearance, complexity, inflexibility, discomfort, lack of strength and durability, and other factors have detracted from the value of prior art designs.

Principal objects of the present invention therefore are to provide a building of the type described which requires minimum time and skill for assembly and disassembly, which is strong and rigid, durable, cheap to purchase and to maintain, which is well insulated, and very importantly, which is simple and flexible in exterior wall arrangement.

In brief summary of some features for purposes of description, the invention includes first and second pluralities of discrete, independently installable and replaceable exterior wall panels adapted for buttressing each other at special vertical joints without intervening studding structure except cornerposts for roof support. Special pin and slot panel mounts, interlocking roof structure, and composite floor framing are disclosed also.

The above and other advantages and objects of the invention will become more readily apparent on examination of the following description, including the drawings in which, like numerals referring to like parts:

FIG. 5 is a plan view detail indicating the relation of a series of wall panels installed;

FIG. 6 is a sectional detail in plan view of the joint between a pair of wall panels installed;

FIG. 7 is a sectional detail in elevation of installation of a panel to a framing member;

FIG. 8 is a view, similar to the FIG. 7 view, of installation of a panel to another framing member;

Figure 1:
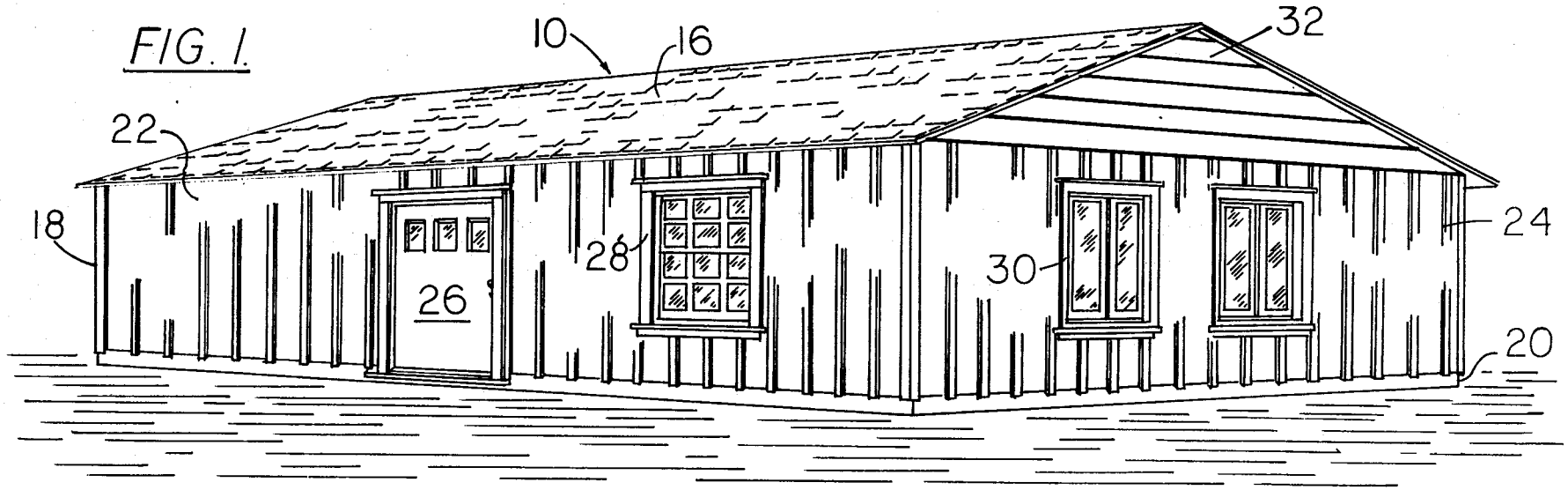
FIG. 1 is an isometric view of the exterior elevation of a building according to this invention.
Figure 2:
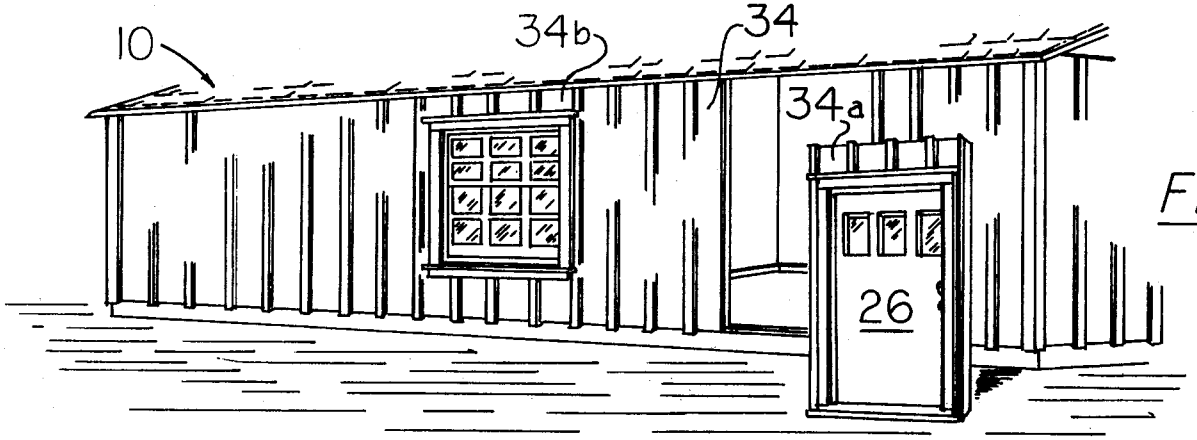
FIG. 2 is a detail of the FIG. 1 structure indicating ready exterior wall panel interchangeability.

FIG. 1 shows a preferred embodiment 10 of the invention in the form of a 16 × 32 foot single story building having a shingle rool 16, supported by corner posts 18 resting on a foundation 20, with sidewall 22 and endwall 24 of reverse-board-and-batten construction supporting door 26 and windows 28, 30. Gable ends 32 of the building may be of ordinary lap siding construction, as indicated.

The overall appearance of the building is conventional and pleasant in appearance, with nothing to indicate the quickassembly pre-fabrication nature of the structure.

The exterior walls are all bearing walls and the interior is free of supports, allowing arrangement of the space under cover in any desired manner.

FIG . 2 indicates a cardinal provision of the invention, free interchangeability of sections or panels **34, 34*a*, 34*b***, which comprise the exterior walls, so that doors and windows and blank sections may be quickly and easily moved from one location to another in the structure, or removed altogether for passage of large objects into and out of the building, without disturbing the rest of the building.

Figure 3:
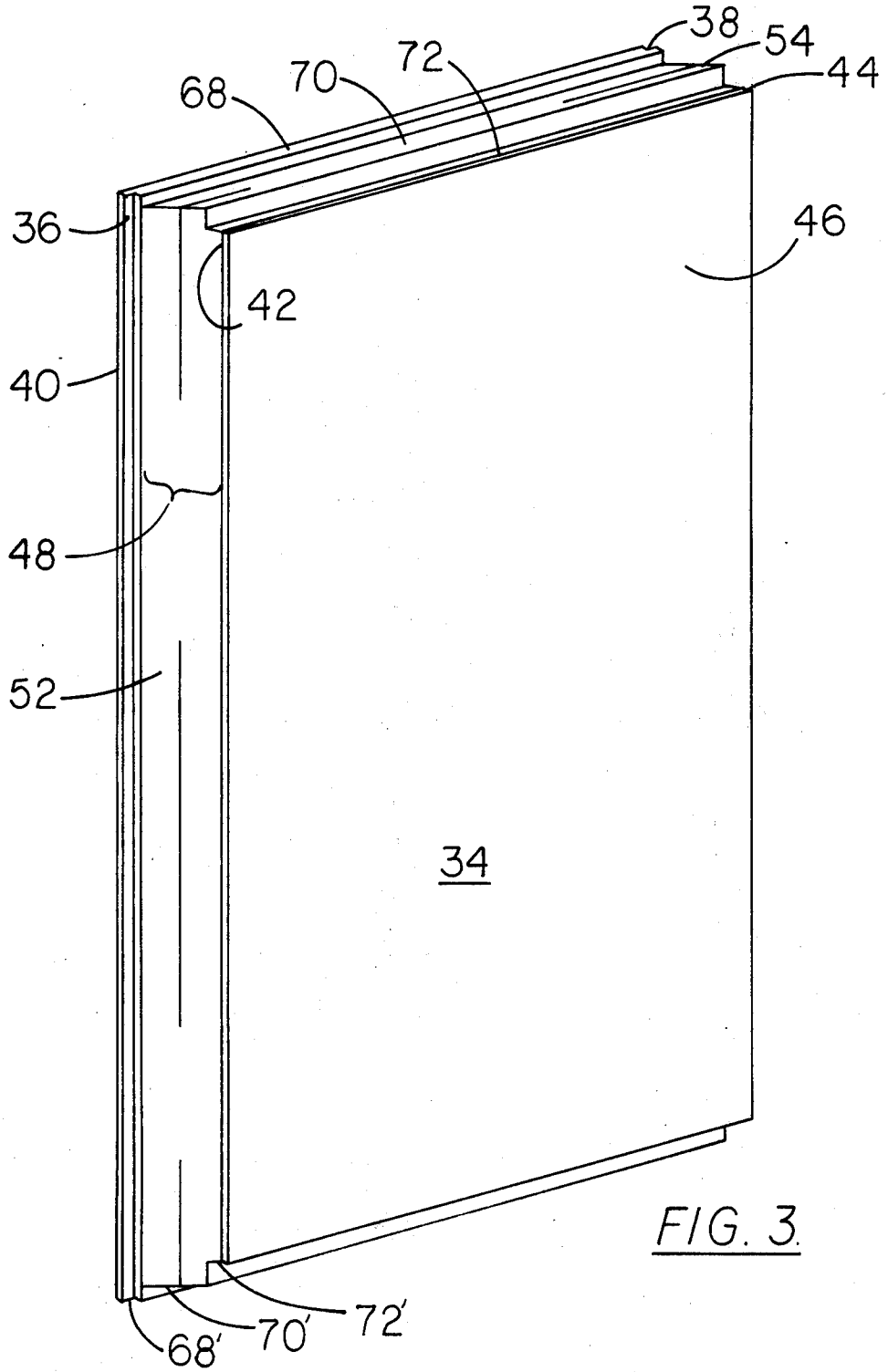
FIG. 3 is an isometric detail of the interior and edges of a wall panel similar to those shown in the preceding Figures.
Figure 4:
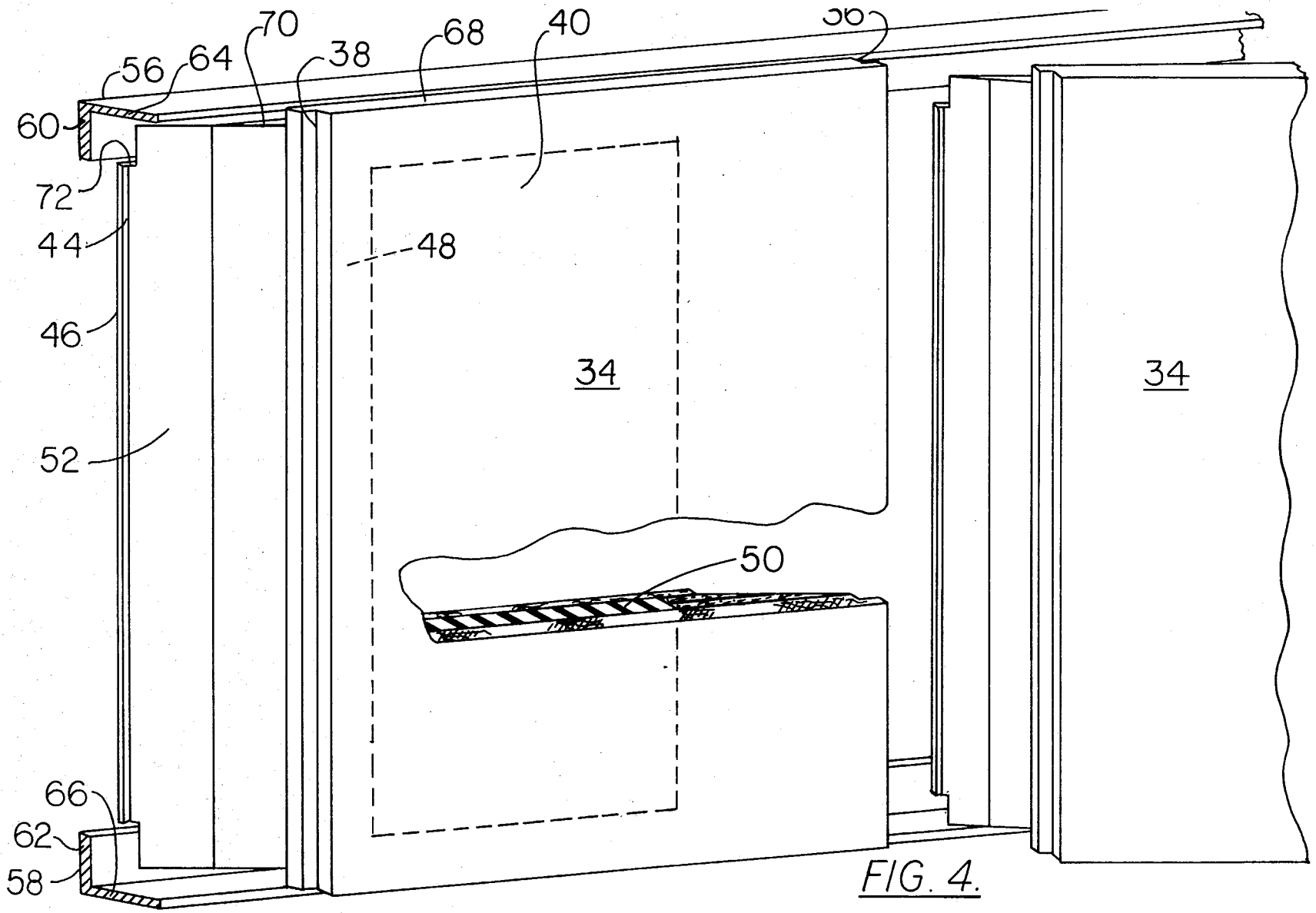
FIG. 4 is an isometric detail showing installation of a wall panel alongside a wall panel previously installed.

FIGS. 3, 4 and 5 show the unique construction and interfitting of the individual panels 34, permitting stud-free weathertight load-sharing, two-man assembly of each exterior-wall in the span between special cornerpost panels, affording great flexibility in locating door and window panels or other special panels. All panels have the same full wall-height and sectional and edge shape, except for necessary variations in edge shape for panels of the second plurality of panels which seat against the cornerposts of the structure.

A typical panel of the first plurality of panels has the general shape in cross-section of a parallelogram with vertical notch structure 36, 38, in the form of step and reverse-step respectively, extending beyond the diagonal lateral edge at the junction of the front or exterior face 40 and vertical notch structure 42, 44 at the junction of the interior or back face 46, formed by extension of the back face to the right beyond the diagonal lateral edge in the plan view shown. The slope and contour of one lateral edge as installed is complementary to that of the next adjacent panel.

The front face 40 comprises preferably a sheet of commercial reverse-board-and-batten facing such as U.S. Plywood "Fir-Roughtex," an exterior plywood type product. The notch structure 36, 42 along one edge abutts and interfits with vertical notch structure 38, 44 in the next adjacent sheet (FIG. 5), spacing apart the remainder of each junction between panels.

The back face 46 of the panel comprises preferably a sheet of interior grade plywood panelling of the type available in many finishes at most lumber yards.

The interior member or midbody of each panel preferably comprises a rectangular peripheral frame 48 of two thicknesses of one-inch "Novaply", a U.S. Plywood Corporation compressed-chipboard product, fastened together along mating flat surfaces, and partial tongue lapped at each corner as by wood screws, not shown. A core 50 is tightly fitted in the frame between the front and back faces. The core is preferably of insulative, plastic-impregnated flame-suppressant Kraft paper honeycomb such as Union Camp Corporation "Uracomb", with the cells transverse to the plane of the panel. The parallel inclined edges 52, 54 of the inner member 48 are recessed, so that when the panels fit together (FIG. 5) the front and back faces join but the bevel edges space apart.

On installation, as shown in FIG. 4 each panel 34 fits between parallel-spaced horizontal legs of the top plate 56 and bottom plate 58. The plates are preferably identical 2 × 2 $\frac{5}{8}$ × $\frac{3}{8}$ inch aluminum angles with legs 60, 62 of the angles in a plane parallel with the side of the building and oriented toward the other angle, and the other legs 64, 66 of the angles distally spaced and horizontally oriented toward the exterior of the building.

The first vertically stepped portion 68 of the panels, termed generally the exterior face or front face structure, represented by the structure of exterior faces 40, extends above and below the plates at the top and bottom respectively. The second vertically stepped portion 70 of the panels, represented by the tops and bottoms of the Nova-Ply mid-bodies or frames 52, which extend less than the first vertically stepped portion, fit closely within the space defined by the horizontal legs of the plates.

The third vertically stepped portion 72 of the panels, termed generally the interior face or back face structure and represented by the notch structure including the thickness of the interior face 46, is still less extensive at top and bottom and fits within the space between the vertical legs 60, 62 of the bottom and top plates. Numbers representing equivalent bottom steps are primed.

As result, the inner face of the outer facing can be sealed against the outer edges of the horizontal legs of the plates, the top and bottom of the second stepped portion can be sealed against the lower surface of the top plate horizontal leg and the top surface of the floor plate horizontal leg, the inner face 74 of the second stepped portion can be sealed against the outer faces of the vertical legs 60, 62 of the plates and the third stepped portion 72 can be sealed against the opposed edges of the vertical legs 60, 62 of the top and bottom plates. Such arrangement forms a quadruple weather seal, complementing the insulative qualities provided by the honeycomb construction of the panels.

Additionally and importantly, the arrangement supports and stabilizes the top plate and stabilizes the bottom plate.

In spite of the complex interlock and supportive relation, on assembly, each individual panel easily and quickly pivots into place between the plates and interlocks with and secures to the preceding panel.

FIG. 6, an enlarged detail of a joint between panels viewed as in FIG. 5 shows typical lateral clearance, securance and sealing of one panel 34 to the next.

At each of the vertical joints 76 between panels a series of machine screws 78 spaced vertically on 22$\frac{1}{2}$ inch centers passes perpendicularly outward through holes 80 the diagonal joint structure of one panel and engages a corresponding series of T nuts 82 embedded in the frame under the board and batten facing of the next adjacent panel complementary structure. Preferably a washer 84 captured by the inner face of the inner panel is disposed under the head of each of the machine screws, which are preferably standared $\frac{1}{4}$ - 20 screws.

A vertical strip of 1 wide by $\frac{1}{8}$ inch thick sponge rubber 86 is cemented to one of the panels along each side of the machine screw locations and on compression by the screw tightly seals along the joint.

Weatherseal and insulation of the vertical joints comprises tight fit of the stepped portions 36, 38 in the board and batten outer face structure, a first dead air space 88, a first foam rubber strip 86, a second dead-air space 90, a second foam rubber strip 86', a third dead air space 92, and tight butt and shear joint 94 between the inner faces of the adjacent panels. The design of the well-spaced hard contacts between the respective inner faces and outer faces, makes the joints accommodative of slight misalignment without loss of weatherseal, and fire retardant and prevents warpage opening of the joints. The diagonal overlap structure prevents misalignment or release of the panels on enlargement of the joints by fire damage.

FIG. 7 details typical securance of a panel 34 to the top plate 56 by a series of horizontal machine screws 78 inserted through holes 96 on 16 inch centers in the top plate vertical leg 60 and passes through the frame 48 of the panel to a T-nut 82 located as described before. A pair of sponge rubber strips 98 and 98' affixed in spaced horizontal relation above and below the machine screws seal the assembly.

FIG. 8, a detail similar to FIG. 7 but inverted, shows typical securance of a panel 34 to floor plate 58 in similar manner to the top plate securance of the panels, but with the additional feature of a supporting seal member 100 interposed between the top of the horizontal leg 66 of the floor plate and the second step 70' of the panel 34 at the bottom.

Rubber seals 102,102' horizontally arranged on either side of the machine screws seal the joint interior.

Machine screw 104 and T-nut 106 connect the floor plate vertical leg 62 and the panel 34.

Figure 9:
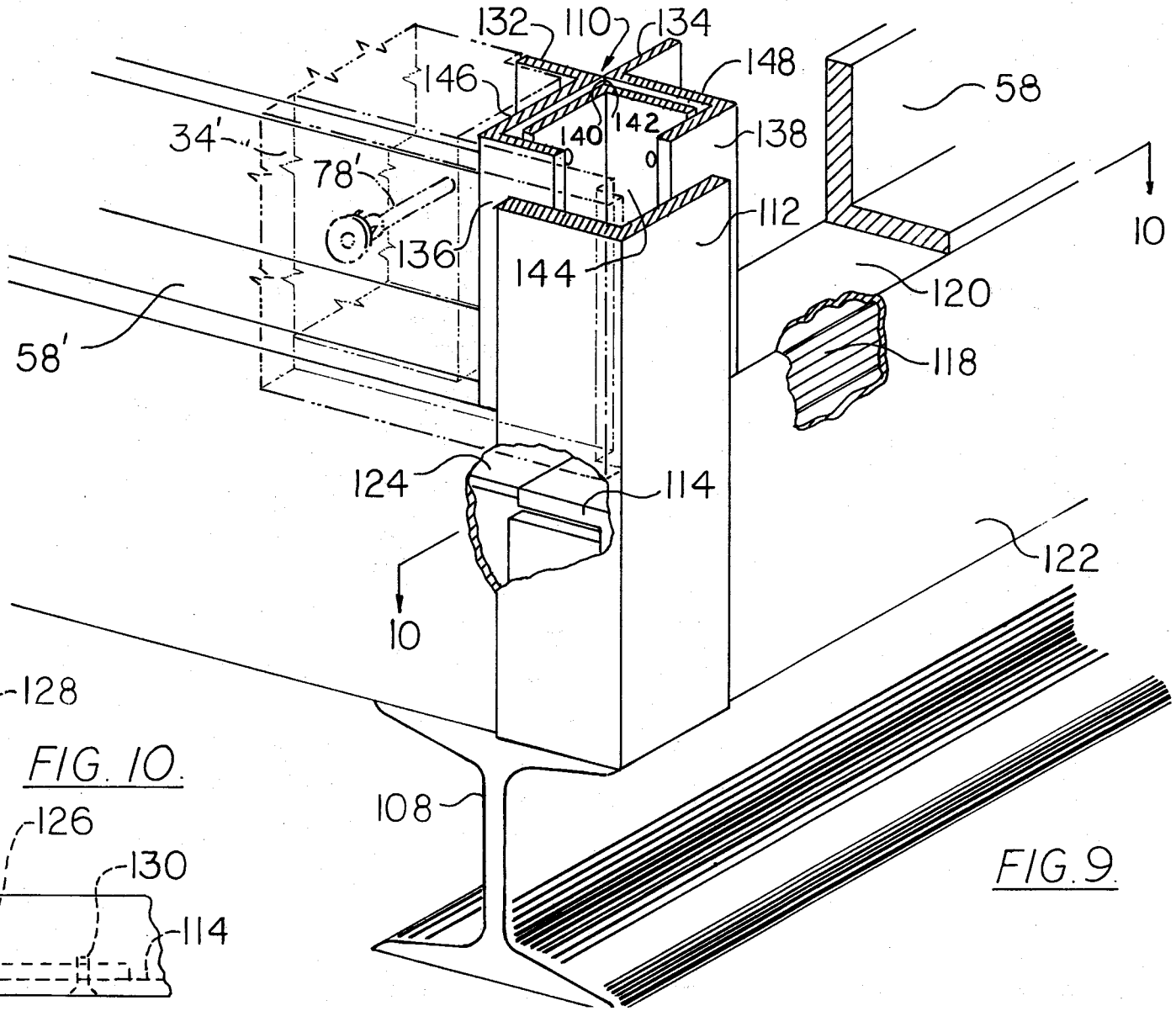
FIG. 9 is an isometric detail partly in section and with portions of structure removed for exposition, showing a lower exterior corner of a building.
Figure 10:
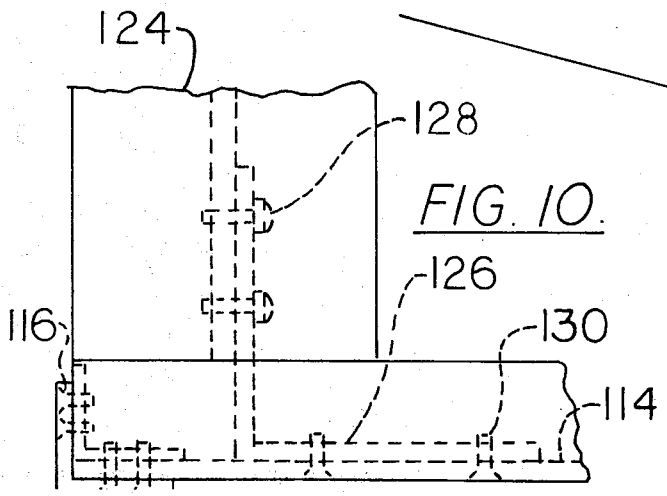
FIG. 10 is a plan detail in partial section taken at 10—10, FIG. 9, overlying structure being removed for exposition.

FIGS. 9 and 10 show a typical corner structure according to this invention. The first plurality of panels comprising the sidewall intermediate portions and the second plurality of panels comprising the panels at the corner, differ in that one edge of each corner panel is modified, forming in part a butt joint with the cornerpost structure.

Preferably the structure disclosed rests on H-beam sills 108 which may be supported on a concrete foundation (not shown) and secured to it by bolts in customary fashion.

Resting on floor joist structure supported by the sills, corner post assembly 110 extends equi-length with the panels from bottom to top of the floor plate-to-top plate structure of the building at the four corners. Vertical tie angle 112 seals the cornerpost and ties it to the foundation structure as follows. A floor joist channel 114, preferably of 1$\frac{5}{8}$ × 4 × 5/16 aluminum rests on the sill at each side of the building with the legs inwardly horizontal and the web flush with the wall of the building and underlies the cornerpost assembly 110 to which it is secured by bolts 116 through a flange of the vertical tie angles 112 forming each corner. A floor 118 rests on the floor joist channels at the side. The side floor plates 58 rest on the top of the floor with the top flange 120 between them of foundation cover angle 122 of 0.063 inch thick aluminum.

Floor joist H-angles 124 extend along the front and back of the building and attach (FIG. 10) at abutting joints to the channels 114 by angle brackets 126 and machine screws 128,130.

Each corner post includes a back-to-back arrangement symmetrical in section about the plan centerplane of each corner, of a pair of $1\frac{1}{2} \times 1\frac{1}{2} \times 3/16$ inch Z section structural shapes 132, 134 with the outer flanges 136, 138 of each convergent and attached by screws, not shown, to the vertical tie-angle 112 which covers a portion of the convergent flanges. In section the outer flange 136, 138 of each of the Z shapes is therefore oriented toward the corner and the inner flange of each is oriented along the inner side of the sidewall structure. Inner angles 140, 142 of the Z shapes meet at the apex of an inner corner post vertical angle 144 which extends in section on either side along the adjacent webs 146, 148 of the Z shapes, covering the webs. The floor plates 58, 58' abutt the Z section webs 146, 148 on either side of the corners. 3/16 diameter flat head rivets are used to secure the posts described together, as indicated, The result is a cross-braced assembly, minimizing both shear and tension loads in the fasteners.

Preferred material for the flooring of the structure is $1\frac{1}{8}$ inches thick exterior grade plywood permitting the use of 4 foot centers in the floor joists, to which the flooring secures by means of machine screws on 16 inch centers.

A further feature of the invention, indicated in FIG. 9 by the phantom lines is that the special corner or end panels 34' have as noted square-edge portions abutting the cornerpost assemblies 110. Attachment screws 78' passing through the inward legs of the Z channels 132, 134 and vertical flanges of floor plate 58 secure the panels to the cornerpost assemblies, and to the floor plate respectively. The corner panels extend in part to the extreme corners of the building, covering the upper portions of the tie angles.

Figure 11:
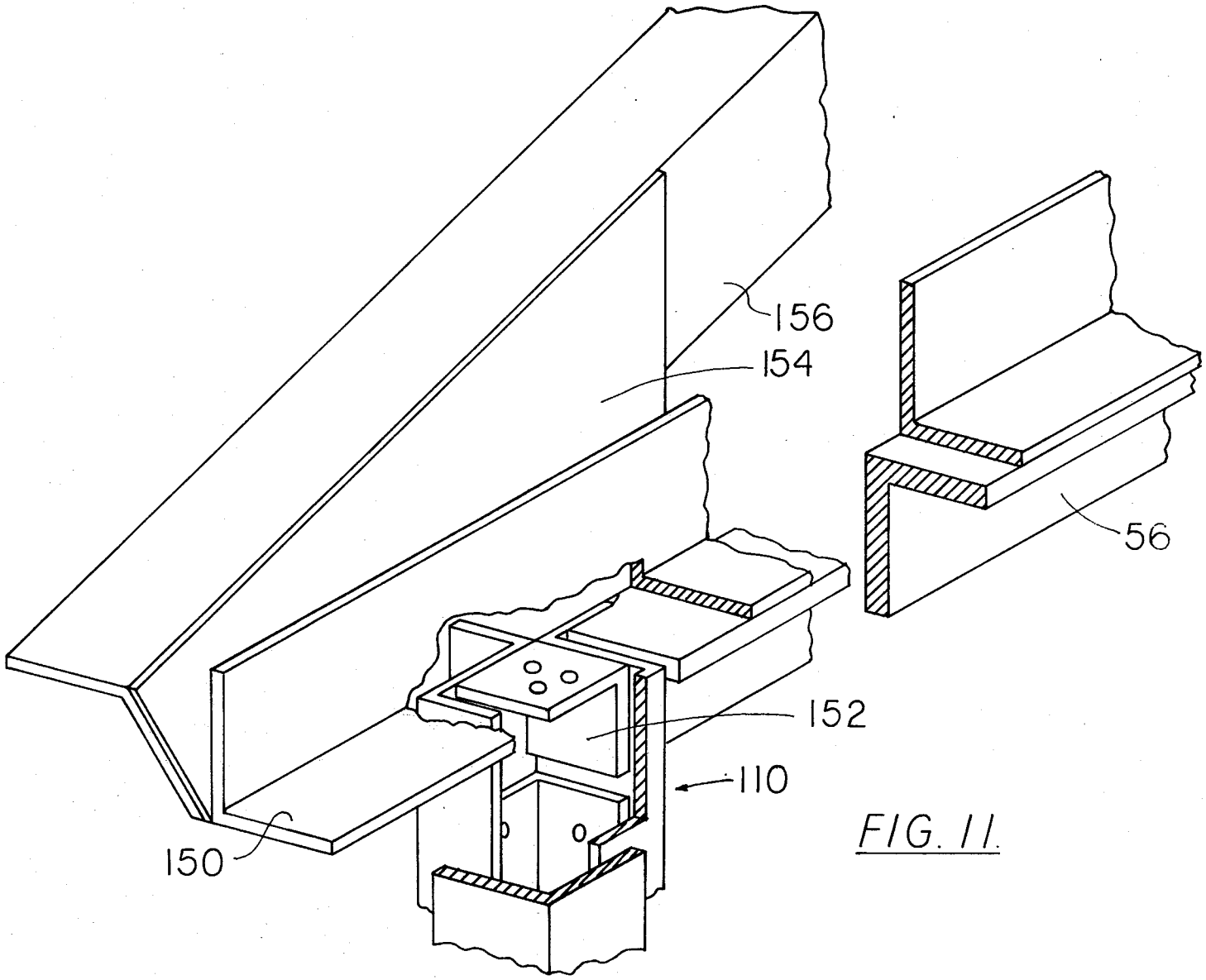
FIG. 11 is an isometric elevation detail partly in section with overlying structure removed for exposition, showing the interior eave-corner of a building.

FIG. 11 shows the top structure at each of the cornerpost assemblies 110. At each end of the structure a rafter 150, preferably of $2 \times 2\frac{1}{2}$ inches aluminum angle rests on the top plate 56 at the corner post assembly 110 and is secured to the cornerpost assembly by machine screws, not shown. passing through an angle bracket 152 secured to the cornerpost assembly by $\frac{1}{4}$ inch rivets, not shown.

Gusset 154 of .090 inch aluminum plate attaches preferably by $\frac{1}{8}$ inch rivets to the truss rafter and to gable end roof joist 156, which is preferably of $2 \times 2\frac{1}{2} \times 3/16$ inch aluminum angle, to form a single piece roof truss. Suitable diagonal supports of 1 inch diameter aluminum tubing are also used in the roof truss.

Other rafters spaced on 48 inch centers are arranged along the structure in conventional manner to support the roof sheathing.

Figure 12:
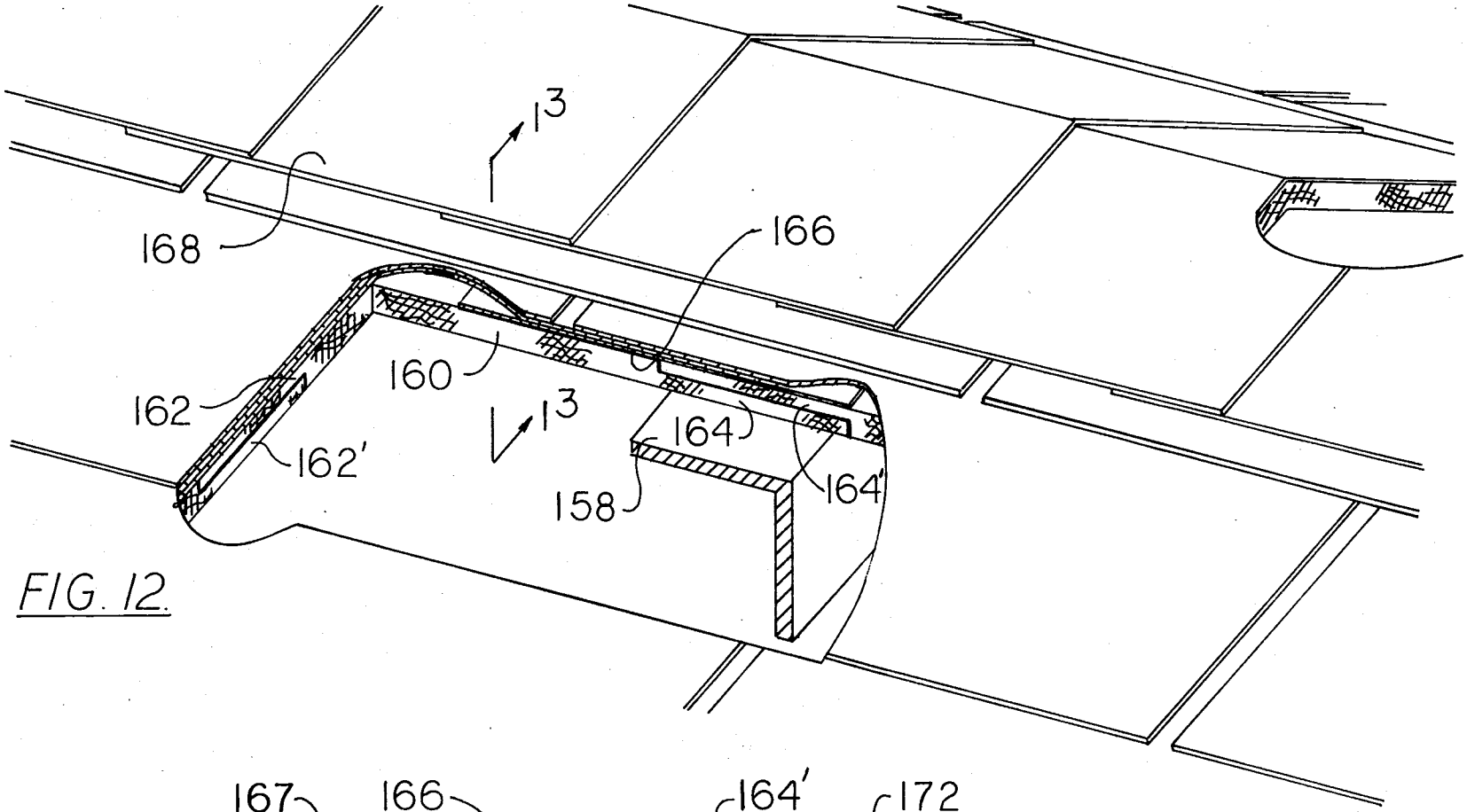
FIG. 12 is an isometric detail of a roof, partly in section with overlying structure removed for exposition.

FIG. 12 shows the simple ridge-roof structure proper of the invention in the typical form of a roof truss joist 158, preferably of $2 \times 2\frac{1}{2} \times 3/16$ angle, of 6061T6 aluminum extrusion, supporting rectangular plywood roof sheathing members 160 conventionally by means of No. 10–24 screws and T nuts, not shown.

Each of the sheathing members 160 has right-angle shiplap step 162 overhanging on the downward side, and a complementary shiplap step 162' on the upper side forming a corresponding joint 162' with the adjacent roof sheathing member. Each piece has likewise a lateral margin step 164 overhanging on one edge and a complementary step 164' on the opposite margin. A flashing 166 of0.032 aluminum sheet extends across the superior margin 164' at each lateral joint and is cemented to the inferior or complementary margin 164 of the adjacent roof sheathing members, to seal out moisture.

Customary asphalt shingle ridge-peaked overlapping shingles 168 and flat roof shingles 168 finish off the upper surface roof structure. The peak of the roof is in one piece, extending on each side from the crest, or crown, toward the eaves for a short space to provide stability and resist internal blast pressure.

Figure 13:
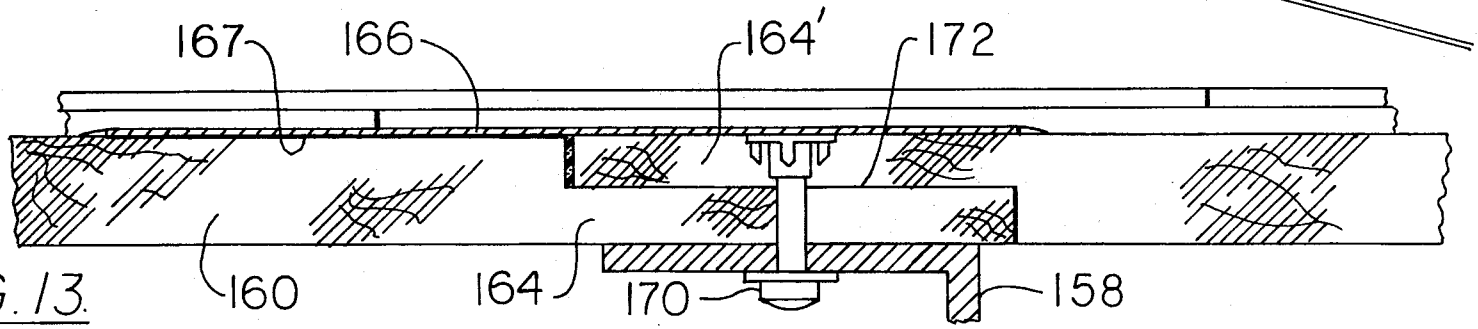
FIG. 13 is a sectional detail in elevation taken at 13—13, FIG. 12.

FIG. 13 illustrates in roof-section taken at 13—13, FIG. 12, the exact relation of the ship-laps 164, 164' between plywood roof sheathing members, 160, roof truss rafter 158 of aluminum angle with horizontal leg secured by machine screw 170 to the sheathing through the shiplap joint 172.

Also shown is flashing 166 (of aluminum or of galvanized sheet metal cemented to the sheathing as at 167). In summary the unique roof structure is not only weather tight but highly insulative because of the triple sealed, lapped, flashed, shingled joints.

Figure 15:
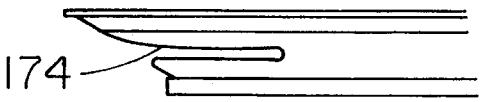
FIGS. 15 and 16 are sectional details taken respectively at 15—15 and 16—16, FIG. 14.
Figure 16:
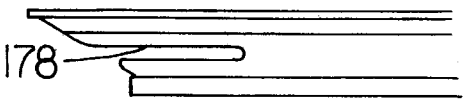
Figure 14:
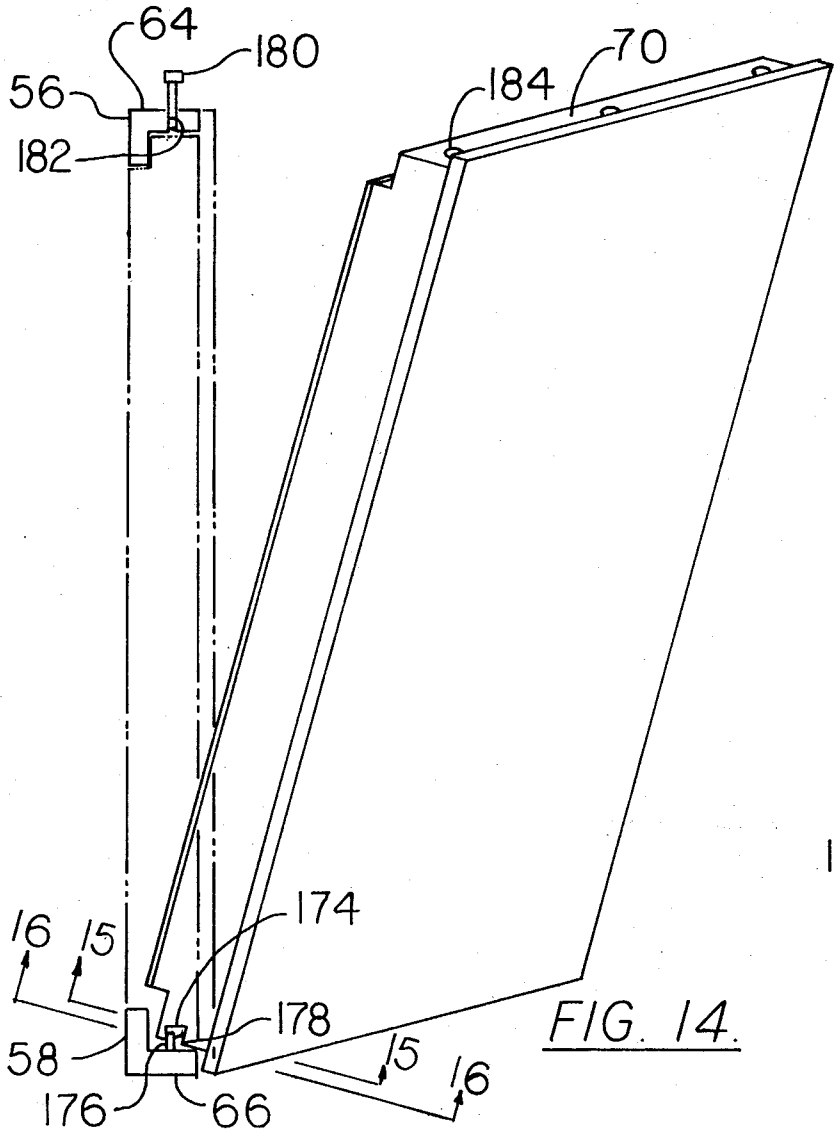
FIG. 14 is an isometric detail indicating installation positions of assembly of a wall panel according to provisions of the invention.

FIGS. 14, 15 and 16 show an optional method of quickattachment of the individual panels 34 between the top plate 56 and the floor plate 58.

Each panel has a bottom slot 174 extending through an edge of the panel for engaging a $\frac{1}{2}$ inch diameter pin 176 fixed in and protruding upwardly from the horizontal leg 66 of the floor plate 58 at a position adapted to engage the panel slot. The panel slot 174 has in vertical section as best indicated in FIG. 14, a narrow throat 178 opening above to greater width to allow rotating the panel into final position between top and floor plates 56 and 58 without binding, after first engagement of the panel slot with pin 176.

The slot in each case opens into the mid-section of the diagonal overlap at an end of the panel.

Vertically oriented assembly pins 180 FIG. 14, passing through vertical holes 182 in the top plate horizontal leg 64 into coaxially alignable vertical holes 184 in the top of the second panel step 70 secure the individual panels to the top plate in quick-attach quick-detach mode. Free pins 180 are preferably $\frac{3}{8}$ inch in diameter and spaced on 20 inch centers, to provide maximum strength of attachment coupled with maximum ease and speed in assembly and disassembly.

Figure 17:
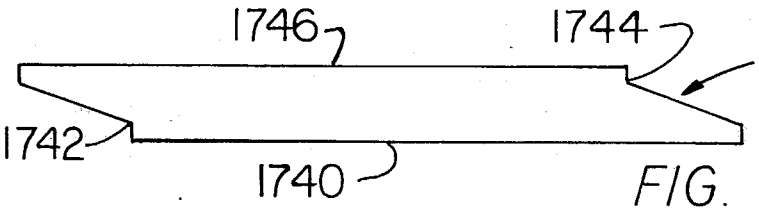
FIG. 17 is a plan view of an alternative shape panel embodiment.

FIG. 17 illustrates in plan view an alternative embodiment 1710 of the invention in which the lateral interlocking features are simplified and adapted to a relatively coarse structure. This structure can be of the type described or can be of another structure such as monolithic foamed-plastic, fused polystyrene foam being an example. The top and bottom stepped-edges are the same as previously described, but the single edge-notch 1742 adjacent the front face 1740 and the notch 1744 adjacent the back face 1746 are deeper relative to the previous embodiment and the complement of the proportion precludes rubber-strip mounting between the joints. Nevertheless, the joint is very effective in excluding rain water, wind driven sea-water and the like. It can be seen that the unique stud-eliminator design of the invention permits the panel of the FIG. 17 embodiment to be pivoted into position about the edges of a previously installed panel in spite of the relatively longer swinging protrusion of the panel as measured from either notch to the adjacent end of the panel.

In conclusion, the plural-overlap self-bracing sidewalls of the invention coupled with the multiple overlap, self-bracing cornerpost and roof structure present a new and useful solution, never before available, to the problem of supplying ready-assembly military, civilian and commercial housing whether for personnel, equipment or manufacturing use.

For example, a dwelling-size building constructed according to the principles of this invention can be erected on a prepared site by four men in one day, using hand tools only.

Obviously, many modifications and variations of the present invention are possible in light of the above teachings. It is, therefore, to be understood that within the scope of the appended claims the invention may be practiced otherwise than as specifically described.

What is claimed and desired to be secured by United States Letters Patent:

1. In a building having a roof, sidewalls including a plurality of pivotally insertable discrete panels, and foundation structure, the improvement comprising: a first plurality of said panels, each having parallel, rectangular-shape exterior and interior faces with a midbody therebetween having first and second lateral planar edge portions parallel-inclined in plan view at an angle to said exterior and interior faces, forming a parallelogram in shape, the exterior faces of all said panels having a lateral extension beyond the midbodies thereof with notch structure vertically along the edge of each lateral extension, the interior faces of all said panels having a lateral extension beyond the midbodies thereof, each of said lateral extensions respectively abutting a next adjacent panel and spacing apart all said midbodies on assembly, with the notch structure interfitting; means for fastening the first plurality of panels laterally together with the first lateral planar edge portion of one panel in complementary overlap with the second lateral planar edge portion of a panel next adjacent thereto, means for detachably securing each of the first plurality of panels to the building including: a plurality of cornerposts connecting the roof and the foundation, a top plate extending between the cornerposts at each side of the building, the top plate comprising an angle having perpendicular first and second planar legs, the first leg thereof extending outward and the second leg extending downward from the inner edge of the first leg, a floor plate parallel-spaced from the top plate along each side of the building, the floor plate comprising an angle having perpendicular first and second planar legs, the first leg thereof extending outward and the second leg extending upward from the inner edge of the first leg; on assembly, said exterior face of each panel extending upward covering the outer edge of the top plate and downward covering the outer edge of the floor plate, said interior face of each panel extending between the lower edge of the second leg of the top plate and the upper edge of the second leg of the floor plate, said midbody extending between the first leg of the top plate and the first leg of the floor plate; the means for detachably securing the panels to the building further including at least one fixed pin upwardly projecting from the first leg of the floor plate, at least one of said panel midbodies having a slot in the bottom edge thereof extending outwardly through a said lateral planar parallel-inclined edge in position for engaging said fixed pin and guiding said panel and securing the bottom thereof in place during assembly, means for detachably affixing each panel of said first plurality of panels to the top plate, and a second plurality of panels, each of said second plurality of panels having a first lateral edge with a portion substantially square in plan view for abutting a said cornerpost and a second lateral edge having struccomplementary to a lateral edge structure of a panel of the first plurality of panels.

* * * * *

UNITED STATES PATENT OFFICE

CERTIFICATE OF CORRECTION

Patent No. 4,051,641 Dated October 4, 1977

Inventor(s) JAMES I. ELLIOTT

It is certified that error appears in the above-identified patent and that said Letters Patent are hereby corrected as shown below:

Col. 8, line 33, delete "struccomplementary" and insert -- structure complementary --.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*